US007528535B2

(12) United States Patent
Ono et al.

(10) Patent No.: US 7,528,535 B2
(45) Date of Patent: May 5, 2009

(54) COLD CATHODE, COLD CATHODE DISCHARGE LAMP, AND METHOD FOR PRODUCING THE SAME

(75) Inventors: Tomio Ono, Kanagawa (JP); Tadashi Sakai, Kanagawa (JP); Naoshi Sakuma, Kanagawa (JP); Mariko Suzuki, Kanagawa (JP); Hiroaki Yoshida, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 304 days.

(21) Appl. No.: 11/075,883

(22) Filed: Mar. 10, 2005

(65) Prior Publication Data

US 2005/0218773 A1 Oct. 6, 2005

(30) Foreign Application Priority Data

Mar. 31, 2004 (JP) ..... 2004-107595

(51) Int. Cl.
*H01J 1/62* (2006.01)

(52) U.S. Cl. ..... 313/491; 313/632; 313/633

(58) Field of Classification Search ..... 313/311, 313/318.01, 318.02, 484, 485, 491, 633, 313/631, 632

See application file for complete search history.

(56) References Cited

U.S. PATENT DOCUMENTS

| | | | | |
|---|---|---|---|---|
| 5,880,559 | A * | 3/1999 | Fox et al. | 313/633 |
| 6,781,294 | B2 * | 8/2004 | Sakai et al. | 313/311 |
| 6,952,075 | B2 * | 10/2005 | Sakai et al. | 313/311 |
| 7,034,447 | B2 * | 4/2006 | Sakai et al. | 313/491 |
| 7,208,874 | B2 * | 4/2007 | Niigaki et al. | 313/542 |
| 7,423,369 | B2 * | 9/2008 | Ono et al. | 313/491 |
| 2002/0140351 | A1 * | 10/2002 | Yamashita et al. | 313/623 |
| 2002/0140352 | A1 * | 10/2002 | Sakai et al. | 313/633 |
| 2004/0061429 | A1 * | 4/2004 | Sakai et al. | 313/491 |
| 2004/0178712 | A1 | 9/2004 | Sakai et al. | |
| 2005/0017644 | A1 * | 1/2005 | Ono et al. | 313/633 |
| 2005/0218773 | A1 * | 10/2005 | Ono et al. | 313/311 |

FOREIGN PATENT DOCUMENTS

| | | |
|---|---|---|
| JP | 8-236083 | 9/1996 |
| JP | 10-69868 | 3/1998 |
| JP | 2000-106130 | 4/2000 |
| JP | 2001-185078 | 7/2001 |
| JP | 2002-25421 | 1/2002 |

(Continued)

OTHER PUBLICATIONS

English-language abstract of JP 2002-29877 laid open Oct. 11, 2002.

(Continued)

*Primary Examiner*—Peter Macchiarolo
(74) *Attorney, Agent, or Firm*—Finnegan, Henderson, Farabow, Garrett & Dunner, L.L.P.

(57) ABSTRACT

A cold cathode discharge lamp includes: a transparent hollow housing; a fluorescent film formed on inner surfaces of the hollow housing; a pair of cold cathodes that are located in the hollow housing; and a discharge gas that contains hydrogen gas sealed within the hollow housing. Each of the cold cathodes includes: a supporting body that has conductivity; an insulating diamond film formed on the supporting body; and an insulating layer that insulates the supporting body from the insulating diamond film.

9 Claims, 7 Drawing Sheets

FOREIGN PATENT DOCUMENTS

| | | |
|---|---|---|
| JP | 2002-260523 | 9/2002 |
| JP | 2002-289139 | 10/2002 |
| JP | 2002-298777 | 10/2002 |
| JP | 2002-367567 | 12/2002 |
| JP | 2003-36805 | 2/2003 |
| JP | 2003-132850 | 5/2003 |
| JP | 2003-263952 | 9/2003 |
| JP | 2003-281991 | 10/2003 |
| JP | 2004-119241 | 4/2004 |

OTHER PUBLICATIONS

English-language abstract of JP 2000-106130 laid open Apr. 11, 2000.

English-language abstract of JP 10-69868 laid open Mar. 10, 1998.

English-language abstract of JP 8-236083 laid open Sep. 13, 1996.

Notice of Rejection issued by the Japanese Patent Office on Apr. 11, 2006, in Japanese Patent Application No. 2004-107595, and Partial English Translation of Office Action.

P.K. Bachmann, et al., "CVD diamond: a novel high γ-coating for plasma display panels?" Diamond and Related Materials, 10 pages 809-817, (2001).

Sakai, et al., "A Discharge Electrode, a Discharge Lamp and a Method for Manufacturing the Discharge Electrode", U.S. Appl. No. 10/899,153, (Jul. 27, 2004).

* cited by examiner

PRIOR ART

COLD CATHODE, COLD CATHODE DISCHARGE LAMP, AND METHOD FOR PRODUCING THE SAME

CROSS-REFERENCE TO RELATED APPLICATIONS

This application is based upon and claims the benefit of priority from the prior Japanese Patent Application No. 2004-107595, filed on Mar. 31, 2004; the entire contents of which are incorporated herein by reference.

BACKGROUND OF THE INVENTION

1) Field of the Invention

The present invention relates to a cold cathode and a cold cathode discharge lamp, and a method for producing the cold cathode and the cold cathode discharge lamp.

2) Description of the Related Art

A cold cathode discharge lamp has a remarkably long service life, and there is an increasing demand for cold cathode discharge lamps as backlight sources for liquid crystal displays. Such cold cathode discharge lamps can be classified into two types: an external electrode type and an internal electrode type. FIG. 7 is a partially broken front view that schematically depicts the configuration of a cold cathode discharge lamp of the conventional external electrode type. The cold cathode discharge lamp 101 of the external electrode type has a fluorescent film 103 formed on inner wall surfaces of a glass valve 102. The glass valve 102 is filled with rare gases, and is then hermetically sealed at both ends. A pair of band-like electrodes 104 is formed on outer wall surfaces of the sealed glass valve 102, and the band-like electrodes 104 each having substantially the same length as the glass valve 102 are located opposite to each other. When an AC power supply is connected to the pair of band-like electrodes 104 of the cold cathode discharge lamp 101, and an AC voltage is applied thereto, a dielectric barrier discharge is caused with the glass valve 102, serving as cathodes, that is an insulator (a dielectric) located under the respective band-like electrodes 104. Then, an electric discharge is caused by the rare gases in the inner space of the glass valve 102 between the two band-like electrodes 104. As a result, the fluorescent film 103 in the glass valve 102 is excited to emit visible light. This technique is disclosed in Japanese Patent Application Laid-Open (JP-A) No. 8-236083, for example.

Another type of such a cold cathode discharge lamp is the internal electrode type. FIG. 8 is a cross-sectional schematic view of the cold cathode discharge lamp of the conventional internal electrode type. This cold cathode discharge lamp contains a discharge gas sealed in a transparent long glass tube 110 that has an inner wall with a fluorescent film thereon. The glass tube 110 is hermetically sealed at both ends by stems 111 and 112 to which lead lines 113 and 114 are attached, respectively. The portions of the lead lines 113 and 114 protruding inside the glass tube 110 each have a configuration in which a diamond member 117 (118) with conductivity is fixed to a metal material 115 (116) such as Ni. Thus, the diamond members 117 and 118 and the metal materials 115 and 116 form cathodes 119 and 120, respectively. Unlike the cold cathode discharge lamp of the external electrode type having insulators (dielectrics) as cathodes, the cold cathode discharge lamp of the internal electrode type uses a conductive material for the cathodes. An AC power supply 122 is connected to the lead lines 113 and 114 leading to the cathodes 119 and 120, respectively, and thus, an AC voltage is applied. The ionized gas in the glass tube 110 then collides with the cathodes 119 and 120, and electrons are emitted from the cathodes 119 and 120. These electrons further ionize the gas. This cycle is repeated to have a snowball effect to cause an electric discharge. The fluorescent film 121 in the glass tube 110 is then excited to emit visible light. Here, the diamond exhibits a negative electron affinity or a very low electron affinity, and has a very high secondary emission efficiency accordingly. The diamond also excels in resistance to sputtering. In view of these facts, the conductive diamond members 117 and 118 are used as part of the cathodes 119 and 120, respectively, so that a cold cathode discharge lamp of an internal electrode type that has a long service life and high luminous efficiency can be obtained. The luminous efficiency represents the ratio of the emission luminance to power consumption. Such a cold cathode discharge lamp is disclosed in JP-A No. 2002-298777, for example.

The cold cathode discharge lamps are often used as the backlights for liquid crystal displays. In recent years, more cold cathode discharge lamps are being used for Liquid crystal display (LCD) television sets than for the liquid crystal displays of personal computers. In the case of a liquid crystal display of a personal computer, one cold cathode discharge lamp is used in one liquid crystal display. In the case of a LCD television set, however, ten to twenty of cold cathode discharge lamps are required, because much higher luminance is required than in a LCD display of a personal computer. To operate a cold cathode discharge lamp, an inverter circuit is required. In the case of a LCD television set, it is preferable to connect a number of cold cathode discharge lamps in parallel to an inverter circuit, rather than preparing an inverter circuit for each of the cold cathode discharge lamps, in terms of the size of the product and the production costs.

In view of the facts, the cold cathode discharge lamp of the external electrode type shown in FIG. 7 is advantageous in that the portions of the glass tube located under the external electrodes can be used as ballast capacitors to stabilize an electric discharge, and a number of such cold cathode discharge lamps can be readily connected in parallel to an inverter circuit. However, as the cathodes are made of glass, the luminous efficiency might not be as high as that of the cold cathode discharge lamp of the internal electrode type that has conductive materials with a high secondary emission efficiency provided as cathodes in the glass tube as shown in FIG. 8. Meanwhile, the start and maintenance of an electric discharge in a cold cathode discharge lamp depend on secondary electrons that are emitted when the ions collide with the cathodes. When the cathodes are made of glass that has a low efficiency of emitting secondary electrons upon collision of one ion, the voltage required for the start and maintenance of an electric discharge is high, and as a result, the power consumption becomes large.

On the other hand, the cold cathode discharge lamp of the internal electrode type shown in FIG. 8 is advantageous in having higher luminous efficiency than the cold cathode discharge lamp of the external electrode type. However, an inverter circuit needs to have the same number of ballast capacitors as the cold cathode discharge lamps to be connected to the inverter circuit. Moreover, there are variations in luminance among the cold cathode discharge lamps, because of the problem with stray capacitance of the ballast capacitors and wiring in the inverter circuit. As a result, there might be a case where only two of the cold cathode discharge lamps, at the most, can be connected in parallel to an inverter circuit in practice.

SUMMARY OF THE INVENTION

It is an object of the present invention to at least solve the problems in the conventional technology.

According to one aspect of the present invention, a cold cathode discharge lamp includes: a transparent hollow housing; a fluorescent film formed on inner surfaces of the hollow housing; a pair of cold cathodes that are located in the hollow housing; and a discharge gas that contains hydrogen gas sealed within the hollow housing, wherein each of the cold cathodes includes: a supporting body that has conductivity; an insulating diamond film formed on the supporting body; and an insulating layer that insulates the supporting body from the insulating diamond film.

According to another aspect of the present invention, a cold cathode includes: a supporting body that has conductivity; an insulating diamond film formed on the supporting body; and an insulating layer that insulates the supporting body from the insulating diamond film.

According to still another aspect of the invention, a cold cathode includes: a hollow housing forming member that forms a part of a hollow housing of a cold cathode discharge lamp; a supporting body having conductivity that is in contact with the hollow housing forming member; an insulating diamond film formed on the supporting body; and an electrode that penetrates the hollow housing forming member and is joined to the supporting body; wherein the hollow housing forming member insulates the supporting body from a surface layer of the insulating diamond film.

According to still another aspect of the invention, a method for producing a cold cathode discharge lamp, includes: forming a hollow housing forming member that forms a part of a hollow housing of the cold cathode discharge lamp; penetrating the hollow housing forming member with an electrode; forming a supporting body having conductivity that is in contact with the hollow housing forming member and is joined to the electrode; forming an insulating diamond film on surfaces of the supporting body; joining the hollow housing forming member to a hollow housing body to form the hollow housing such that the supporting body and the insulating diamond film are located inside the hollow housing; and filling the hollow housing with a discharge gas.

The other objects, features, and advantages of the present invention are specifically set forth in or will become apparent from the following detailed description of the invention when read in conjunction with the accompanying drawings.

DETAILED DESCRIPTION

Exemplary embodiments relating to the present invention will be explained in detail below with reference to the accompanying drawings.

Figure 1:
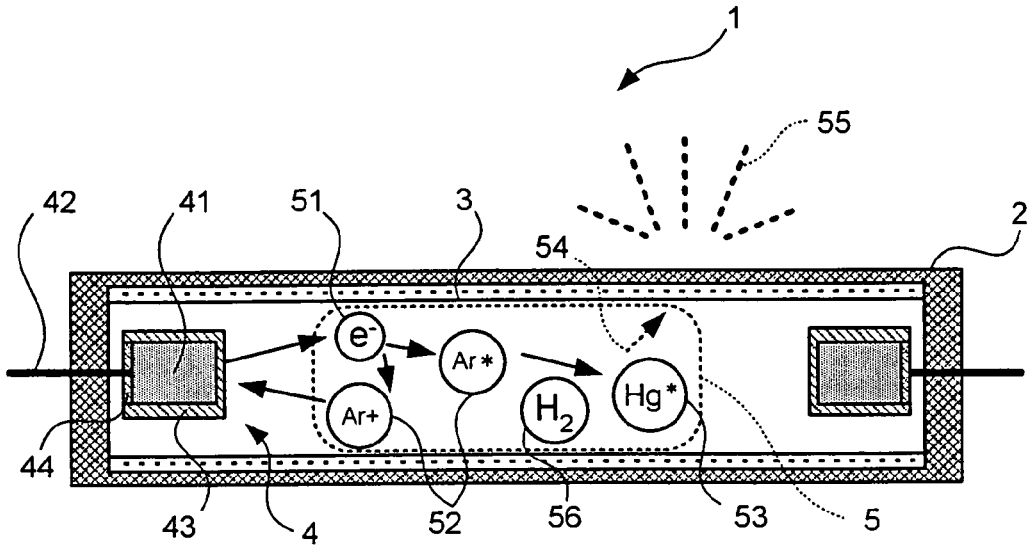
FIG. 1 is a cross-sectional schematic view of a cold cathode discharge lamp according to a first embodiment of the present invention.

FIG. 1 is a cross-sectional schematic view of a cold cathode discharge lamp according to a first embodiment of the present invention. The cold cathode discharge lamp 1 includes: a transparent hollow housing 2 that is hollow inside and has a hermetic configuration; a fluorescent film 3 formed on inner walls of the hollow housing 2; a pair of insulating cathodes 4 provided inside the hollow housing 2; and a discharge gas 5 that contains inert gases 52 such as Ne gas and Ar gas, a very small amount of mercury 53, and a very small amount of hydrogen 56. The insulating cathodes 4 are equivalent to the cold cathodes in claims.

The hollow housing 2 is formed by hermetically sealing both ends of a transparent glass tube having a cylindrical shape, for example. The fluorescent film 3 is made of a fluorescent material that emits visible light 55, when ultraviolet rays 54 irradiate the fluorescent film 3.

Each of the insulating cathodes 4 includes: a supporting body 41 made of a conductive material such as a metal; an extraction electrode 42 that applies a voltage from the outside of the hollow housing 2 to the supporting body 41; an insulating diamond film 43 formed on surfaces of the supporting body 41; and an insulating layer 44 that prevents short-circuiting between the insulating diamond film 43 and the supporting body 41 at the time of an electric discharge. Each extraction electrode 42 extends from the inside to the outside of each corresponding end of the hollow housing 2.

The supporting body 41 of each insulating cathode 4 has a pillar-like conductive configuration such as a metallic rod, and is located inside the hollow housing 2 such that its longitudinal direction corresponds with the longitudinal direction of the hollow housing 2. In this arrangement, each extraction electrode 42 is attached to a surface of the corresponding supporting body 41 facing the corresponding end of the hollow housing 2 at a shorter distance (the surface being hereinafter referred to as the bottom surface).

Figure 7:
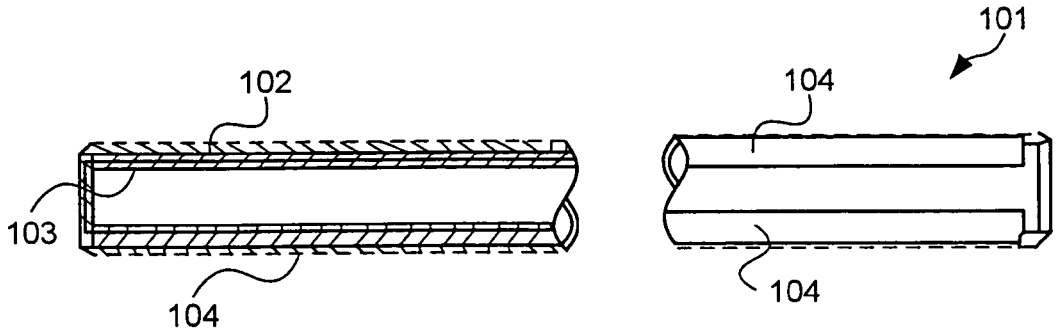
FIG. 7 is a partially broken schematic front view of a conventional cold cathode discharge lamp of an external electrode type.
Figure 8:
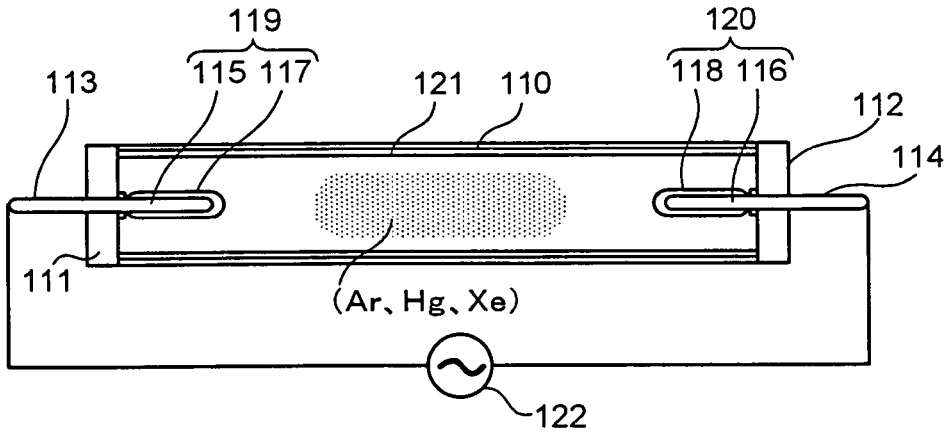
PRIOR ART FIG.8
FIG. 8 is a cross-sectional schematic view of a conventional cold cathode discharge lamp of an internal electrode type.

Each insulating diamond film 43 exhibits improved secondary emission efficiency, and is formed on the surfaces of each corresponding supporting body 41 except the bottom surface. One example of such insulating diamond film 43 with the improved secondary emission efficiency have a hydrogen-terminated surface. Each insulating diamond film 43, which is an insulator (a dielectric), is formed on the corresponding conductive supporting body 41, so that the insulating diamond film 43 functions in the same manner as the glass tube in the cold cathode discharge lamp of the conventional external electrode type shown in FIG. 7 at the time of an electric discharge. In short, each insulating diamond film 43 functions as a ballast capacitor. The cold cathode discharge lamp 1 is the same as the cold cathode discharge lamp of the internal electrode type shown in FIG. 8 in that the insulating cathodes 4 are located inside the hollow housing 2, but is the same as the cold cathode discharge lamp of the external electrode type shown in FIG. 7 in that the insulating cathodes 4 discharge substantially via ballast capacitors. In the present invention, the insulating diamond films 43 are diamond films that are generally regarded (or behave) as insulators among various types of diamond films. For example, insulators that contain a small amount of donor atoms or acceptor atoms may be employed for the insulating diamond films 43, as long as they behave as insulators.

Each insulating layer 44 is formed on the bottom surface of each corresponding supporting body 41 so as to prevent contact between the surface of the insulating diamond film 43 and the supporting body 41. With the insulating layer 44, current can be prevented from flowing from the surface of the insulating diamond film 43 to the conductive supporting body 41 at the time of an electric discharge, and a difference in potential between the insulating diamond film 43 and the supporting body 41 can be maintained, as described later. Therefore, the insulating layer 44 is formed so as to prevent the interface between the insulating diamond film 43 and the supporting body 41 from being exposed to the discharge gas 5 during an electric discharge.

The inert gases 52 such as rare gases in the discharge gas 5 contained in the hollow housing 2 are used to cause an electric discharge in the hollow housing 2. The mercury 53 is excited by collision of electrons 51 against the inert gases 52 such as ionized or excited rare gases, and the mercury 53 then emits the ultraviolet rays 54 to excite the fluorescent material in the fluorescent film 3. The hydrogen 56 serves to hydrogen-terminate the surfaces of the insulating diamond films 43 formed on surfaces of the respective insulating cathodes 4. The insulating diamond films 43 formed on surfaces of the respective supporting bodies 41 have the surfaces terminated with hydrogen so as to obtain higher secondary emission efficiency, but the hydrogen, which terminates the surfaces, gradually disappear after the ionized inert gases 52 collide against the surfaces of the insulating diamond films 43 during an electric discharge. Therefore, the very small amount of hydrogen 56 is introduced into the discharge space, so that the hydrogen termination of the surfaces of the insulating diamond films 43 can be maintained by discharge plasma.

Figure 2A:
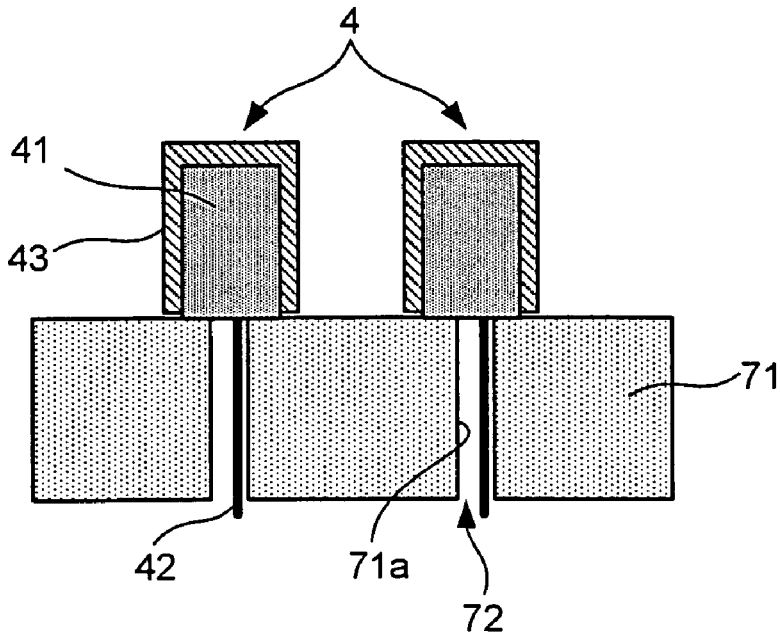
FIG. 2A is a schematic view for the explanation of a process for producing each of the insulating cathodes shown in FIG. 1.

FIGS. 2A to 2D depict a method for producing each of the insulating cathodes 4. As shown in FIG. 2A, the supporting bodies 41 with the extraction electrodes 42 and a holder 71 are first prepared. This holder 71 has surfaces 71*a* forming holes 72. The supporting bodies 41 are placed on the holder 71 so that the extraction electrodes 42 are inserted into the respective holes 72, as shown in FIG. 2A. In this state, the insulating diamond films 43 are formed on the surfaces of the respective supporting bodies 41 by a plasma Chemical Vapor Deposition (CVD) technique. The method for producing diamond films by a CVD technique is a known art, and therefore, explanation of it is not repeated herein. As is apparent from FIG. 2A, the insulating diamond films 43 are not formed on the respective bottom surfaces provided with the extraction electrodes 42. The formation of the insulating diamond films 43 may be carried out by a different technique from the above, as long as the insulating diamond films 43 are formed on the surfaces of the respective supporting bodies 41 except the bottom surfaces. For example, plasma CVD may be performed, with the bottom surface and the extraction electrode 42 of each of the supporting bodies 41 being covered. In such a case, the holder 71 is not necessary.

Figure 2B:
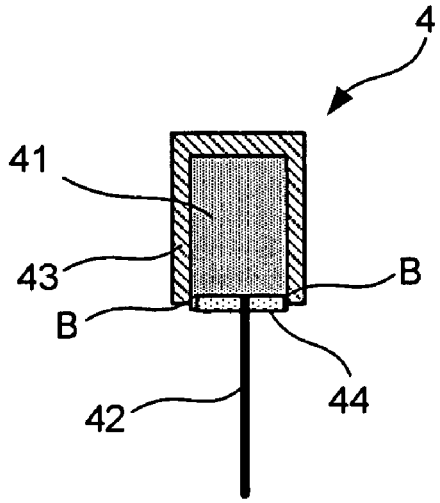
FIG. 2B is a schematic view for the explanation of another process for producing the insulating cathode.

Each of the supporting bodies 41 having the extraction electrode 42 is then pulled out of the holder 71, as shown in FIG. 2B, and the insulating layer 44 is formed on the bottom surface from which the extraction electrode 42 extends. The insulating layer 44 needs to be formed not to expose a boundary region B located between the insulating diamond film 43 and the supporting body 41 on the side of the bottom surface (or to cover at least the boundary region B located between the insulating diamond film 43 and the supporting body 41).

Figure 2C:
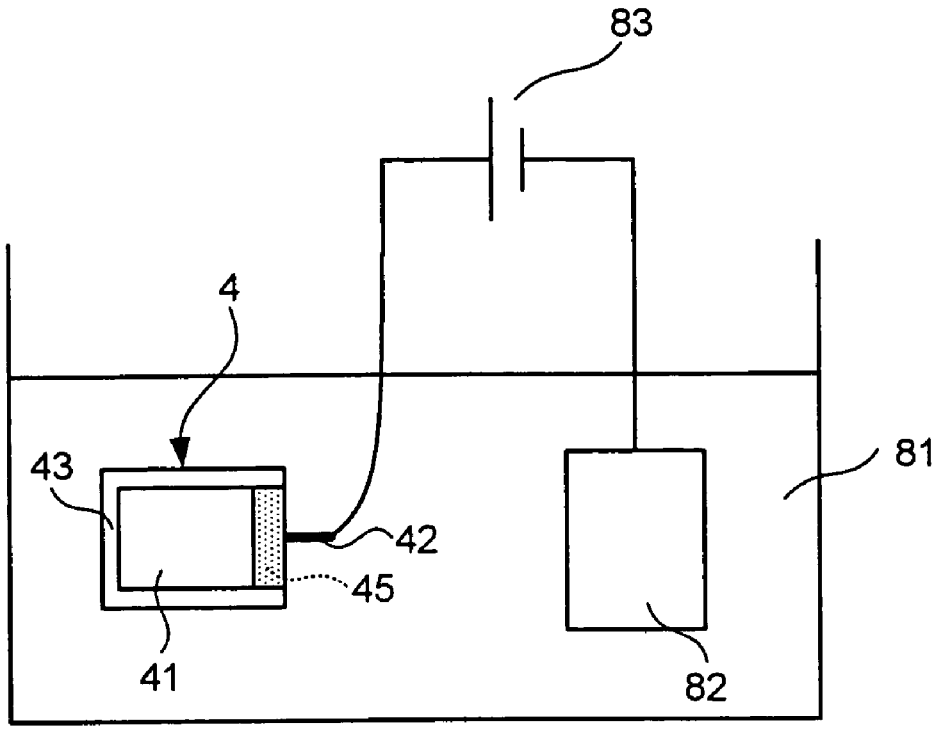
FIG. 2C is a schematic view for the explanation of yet another process for producing the insulating cathode.

The insulating layer 44 can be formed by a CVD technique or a Physical Vapor Deposition (PVD) technique such as vapor deposition or sputtering, but may also be formed by the following technique. In this case, the supporting body 41 is made of a metallic material containing Ti, Ta, Cu, or Al. After the insulating diamond film 43 is formed on surfaces of the supporting body 41 in the procedure shown in FIG. 2A, the supporting body 41 and a metal electrode 82 are placed in an acid solution 81 such as a sulfate acid solution as shown in FIG. 2C. The positive pole of a DC power supply 83 is then connected to the extraction electrode 42, while the negative pole of the DC power supply 83 is connected to the metal electrode 82, thereby causing electrolysis. As a result, the bottom surface of the supporting body 41 becomes porous, and a porous layer 45 is formed. Having excellent corrosion resistance, the insulating diamond film 43 is not affected by the electrolysis. If the extraction electrode 42 is made of a metallic material containing Ti, Ta, Cu, or Al, the extraction electrode 42 also becomes porous like the bottom surface of the supporting body 41. Using a metallic material that does not contain Ti, Ta, Cu, and Al, a porous coating film cannot be formed readily. For example, a metallic material containing Ni, Kovar, or iron, may be employed for the extraction electrode 42.

Figure 2D:
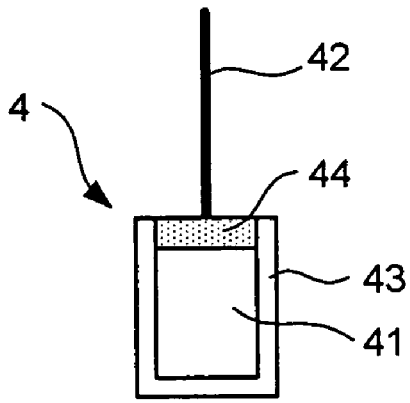
FIG. 2D is a schematic view for the explanation of still another process for producing the insulating cathode.

After the porous layer 45 is formed thoroughly on the bottom surface of the supporting body 41, the supporting body 41 is pulled out of the acid solution 81, and the porous layer 45 is brought into contact with boiling water or heated steam. By doing so, the porous layer 45 is oxidized, and a pore filling process is performed to fill the pores of the porous layer 45. As shown in FIG. 2D, through the pore filling process, the porous layer 45 is oxidized, and the pores of the porous layer 45 are filled up. Thus, the insulating layer 44 is formed. The insulating cathode 4 formed in this manner is placed in the hollow housing 2 made of glass or the like and has the fluorescent film 3 formed inside. The discharge gas 5 is then introduced into the hollow housing 2, and the hollow housing 2 is sealed at both ends. Thus, the cold cathode discharge lamp 1 is produced.

The operation of the cold cathode discharge lamp 1 having the configuration is explained. As an AC power supply is connected to each of the extraction electrodes 42 and an AC voltage is applied, the electrons remaining in the discharge space are accelerated and collide with the atoms of the inert gases 52. As a result, the atoms of the inert gases 52 are ionized. The ions thus generated collide with the corresponding insulating cathode 4 having the insulating diamond film 43 as the discharge surface. At this point, the electrons 51 are emitted from the insulating diamond film 43, and are then accelerated to collide with the atoms of the inert gases 52. As a result, the atoms of the inert gases 52 are ionized. This cycle is repeated to have a snowball effect in the hollow housing 2, and an electric discharge is finally caused. Once an electric discharge is started, however electric charges are accumulated on the insulating diamond film 43 of the insulating cathode 4. As an electric field generated by those electric charges acts in such a direction as to hinder the electric discharge, the electric discharge is ended in a short time. Therefore, an AC voltage is applied to the extraction electrode 42 to reverse the voltage applying direction, so that the electric discharge can be continued by repeating the cycle over a long period of time. In short, the cold cathode discharge lamp 1 according to the present invention is of a dielectric barrier discharge type.

Since the insulating diamond film 43 exhibits high secondary emission efficiency and has the hydrogen-terminated surface, a large number of electrons 51 are emitted due to the ion collision during the electric discharge. As a result, the discharge starting voltage and the voltage required for maintaining the electric discharge decrease. Further, the surface of the insulating diamond film 43 gradually loses hydrogen due to the collision with the ionized inert gases 52. However, a very small amount of hydrogen 56 exists in the discharge space. Accordingly, the surface of the insulating diamond film 43 is again hydrogen-terminated with discharge plasma, and thus, the hydrogen termination is maintained. With this configuration, even after a long period of time has passed since the start of the electric discharge, the secondary emission efficiency of the insulating diamond film 43 does not drop.

When the insulating diamond film 43 has a hydrogen-terminated surface, a p-type thin conductive layer (hereinafter referred to as the surface conductive layer) is known to be formed on the surface of the insulating diamond film 43 during the electric discharge, even if the insulating diamond film 43 is undoped. In short, the surface of the insulating diamond film 43 has conductivity during the electric discharge.

Figure 3A:
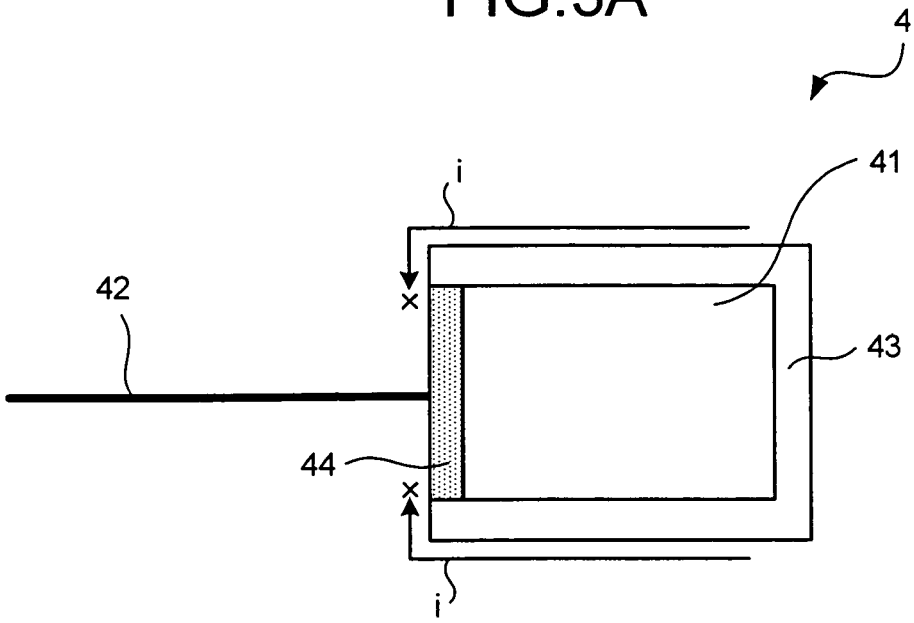
FIG. 3A is a cross-sectional schematic view of an insulating cathode during an electric discharge when an insulating layer is formed on the bottom surface of the supporting body.
Figure 3B:
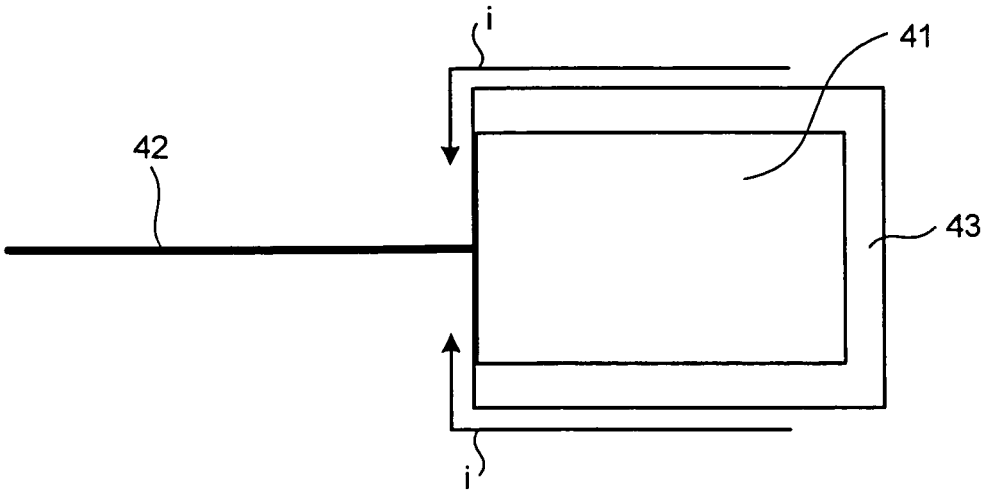
FIG. 3B is a cross-sectional schematic view of an insulating cathode during an electric discharge when an insulating layer is not formed on the bottom surface of the supporting body.

FIG. 3A is a cross-sectional schematic view of an insulating cathode during an electric discharge when an insulating layer is formed on the bottom surface of the conductive supporting body. FIG. 3B is a cross-sectional schematic view of an insulating cathode during an electric discharge when an insulating layer is not formed on the bottom surface of the conductive supporting body. When the insulating layer 44 is not employed as shown in FIG. 3B, a leak path is formed. The leak path serves as a passage for a current i to flow to the supporting body 41 through the surface of the insulating diamond film 43 (the surface exposed to the discharge gas 5) during an electric discharge. More specifically, the surface conductive layer formed on the insulating diamond film 43 causes short-circuiting between the supporting body 41 and the surface of the insulating diamond film 43. As a result, the surface of the insulating diamond film 43 and the supporting body 41 have the same potential, and the insulating diamond film 43 fails to maintain the voltage required to function as a ballast capacitor.

On the other hand, when the insulating layer 44 is employed as shown in FIG. 3A, even if a surface conductive layer is formed on the insulating diamond film 43, the surface conductive layer is separated from the supporting body 41 by the insulating layer 44. More specifically, the current i flowing on the surface of the insulating diamond film 43 is shut off by the insulating layer 44, and does not reach the supporting body 41. The surface of the insulating diamond film 43 is insulated from the supporting body 41 by the insulating layer 44, so that the insulating diamond film 43 can maintain the voltage required to function as a ballast capacitor.

According to the first embodiment, each of the cold cathodes 4 includes the insulating layer 44 that prevents direct contact between the surface of the insulating diamond film 43 and the supporting body 41, as described above. During an electric discharge using the discharge gas 5 containing a very small amount of hydrogen 56 introduced into the discharge space, short-circuiting between the supporting body 41 and the surface conductive layer formed on the surface of the insulating diamond film 43 is prevented so as to avoid a break in the electric discharge of a dielectric barrier discharge type. Thus, the insulating diamond film 43 can function as a ballast capacitor. As a result, two or more cold cathode discharge lamps 1 can be connected in parallel to an inverter circuit.

As the discharge gas 5 contains a very small amount of hydrogen 56, the surface of each insulating diamond film 43 remains in the hydrogen-terminated state even during an electric discharge. Accordingly, excellent secondary emission characteristics can be maintained. Thus, high luminous efficiency can be achieved, even though an electric discharge of a dielectric barrier type is performed. Further, the voltage required for starting and maintaining an electric discharge can be lowered, and the power consumption can be reduced accordingly.

Figure 4:
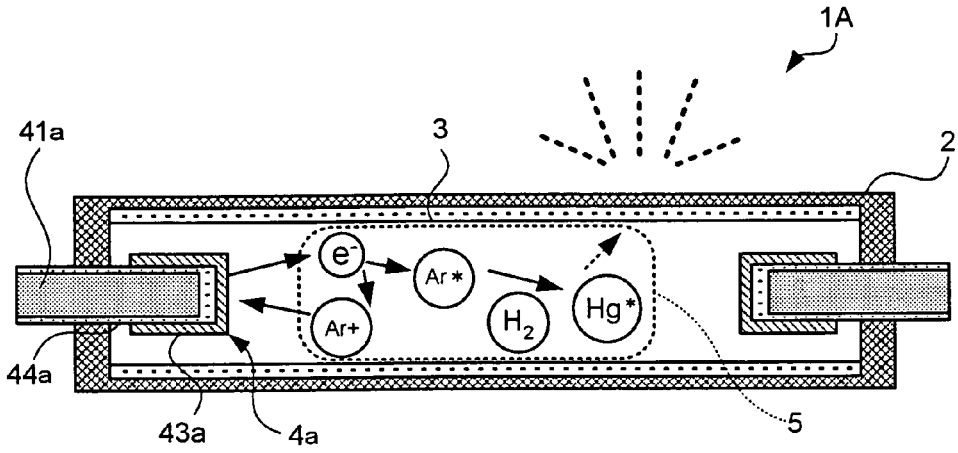
FIG. 4 is a cross-sectional schematic view of a cold cathode discharge lamp according to a second embodiment of the present invention.

FIG. 4 is a cross-sectional schematic view of a cold cathode discharge lamp according to a second embodiment of the present invention. In FIG. 4, the same components as those of the first embodiment shown in FIG. 1 are denoted by the same reference numerals as in FIG. 1, and therefore, a detailed description thereof is not repeated herein. A cold cathode discharge lamp 1A has insulating cathodes 4*a* that are different from the insulating cathodes 4 of the first embodiment shown in FIG. 1. More specifically, each of the insulating cathodes 4*a* is made of a conductive material, and has a supporting body 41*a* that is longer than each supporting body 41 of the first embodiment and has an insulating layer 44*a* formed on its surfaces. Each of the supporting bodies 41*a* is located at either end of the hollow housing 2, and extends from the inside to the outside of the hollow housing 2. In addition, an insulating diamond film 43*a* is formed on the surfaces of each supporting body 41*a* that are located inside the hollow housing 2.

The insulating layer 44*a* formed on the surfaces of each supporting body 41*a* can be formed by a known film forming technique, such as a sputtering technique, a vapor deposition technique, or a CVD technique. The insulating diamond film 43*a* formed over the insulating layer 44*a* can be formed by a known CVD technique. Although the insulating layer 44*a* is formed on all the surfaces of each supporting body 41*a* in FIG. 4, it is possible to form the insulating layer 44*a* only at the regions in which the ends of the insulating diamond film 43*a* are located, so that the surfaces of the insulating diamond film 43*a* are not brought into contact with the supporting body 41*a* inside the hollow housing 2 that serves as a discharge space. More preferably, the insulating layer 44*a* should be interposed between the entire insulating diamond film 43*a* and the supporting body 41*a*. With this configuration, short-circuiting between the surface conductive layer formed on the insulating diamond film 43*a* and the supporting body 41*a* during an electric discharge can be prevented.

As the hollow housing 2 is made of glass and the insulating layer 44*a* formed on the surfaces of each supporting body 41*a* is a glass-coated film, the glass portion of the hollow housing 2 is glass-joined to the glass coating (the insulating layer 44*a*) on the surfaces of the supporting body 41*a* when the ends of the hollow housing 2 are hermetically sealed. As a result, the sealing process can be easily carried out on the cold cathode discharge lamp 1A. In the second embodiment, the portions of the respective supporting bodies 41*a* existing outside the hollow housing 2 can be used as the equivalents of the extraction electrodes 42 of the first embodiment.

According to the second embodiment, each of the insulating cathodes 4*a* has the supporting body 41*a* that is made of a conductive material and extends from the inside to the outside of the hollow housing 2. The surfaces of the supporting body 41*a* are coated with the insulating layer 44*a*, and are partially coated with the insulating diamond film 43*a* inside the hollow housing 2. Accordingly, short-circuiting between the supporting body 41*a* and the surface conductive layer formed on the surface of the insulating diamond film 43*a* during an electric discharge can be prevented, and the insulating diamond film 43*a* can function as a ballast capacitor. In addition, as the discharge gas 5 contains a very small amount of hydrogen 56, the surface of each insulating diamond film 43*a* remains in the hydrogen-terminated state even during an electric discharge. Accordingly, excellent secondary emission characteristics can be maintained. Thus, high luminous efficiency can be achieved, even though an electric discharge of a dielectric barrier type is performed. At the same time, the voltage required for starting and maintaining an electric discharge can be lowered. As a result, the cold cathode discharge lamp 1A that has low power consumption and high luminous efficiency can be obtained. Furthermore, two or more cold cathode discharge lamps 1A can be connected in parallel.

Figure 5:
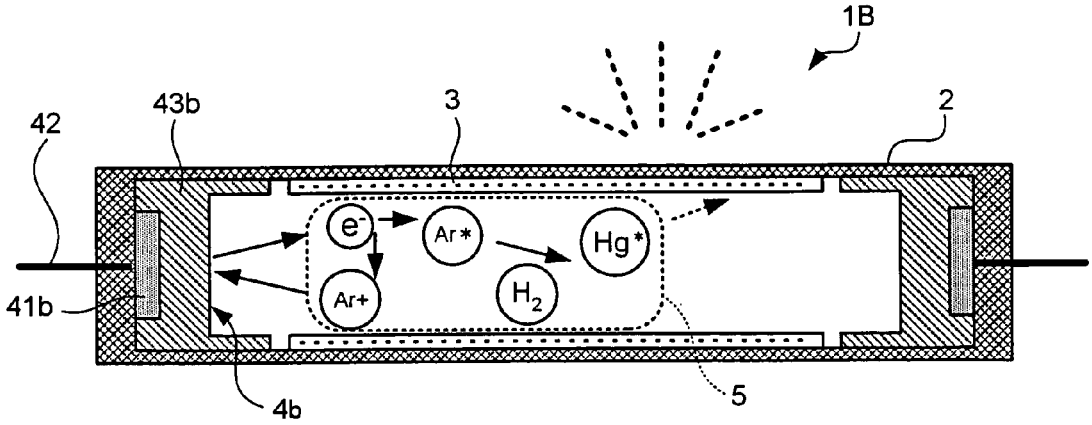
FIG. 5 is a cross-sectional schematic view of a cold cathode discharge lamp according to a third embodiment of the present invention.

FIG. 5 is a cross-sectional schematic view of a cold cathode discharge lamp according to a third embodiment of the present invention. In FIG. 5, the same components as those of the first embodiment shown in FIG. 1 are denoted by the same reference numerals as in FIG. 1, and therefore, a detailed description thereof is not repeated herein. A cold cathode discharge lamp 1B has insulating cathodes 4*b* that are different from the insulating cathodes 4 of the first embodiment shown in FIG. 1. More specifically, each of the insulating cathodes 4*b* includes a film-like supporting body 41*b* and an insulating diamond film 43*b*. The supporting body 41*b* is located substantially in contact with the corresponding inner wall surface of the hollow housing 2, and is connected to the end of the extraction electrode 42 located on the same plane as the inner wall surface of the hollow housing 2. The insulating diamond film 43*b*, in cooperation with the hollow housing 2, covers the supporting body 41*b*. One of the side surfaces of the supporting body 41*b* is in contact with the hollow housing 2 as described above, and accordingly, is covered with the hollow housing 2. The other surfaces of the supporting body 41*b* are covered with the insulating diamond film 43*b*. Even if a surface conductive layer is formed on the insulating diamond film 43*b*, the surface conductive layer is separated from the supporting body 41*b* by the hollow housing 2. Made of glass having insulating properties, the hollow housing 2 serves as an insulating layer. Because of this, the current flowing on the surface of the insulating diamond film 43*b* is shut off by the hollow housing 2 and does not reach the supporting body 41*b*. In this manner, the hollow housing 2 insulates the supporting body 41*b* from the surface of the insulating diamond film 43*b*.

Figure 6A:
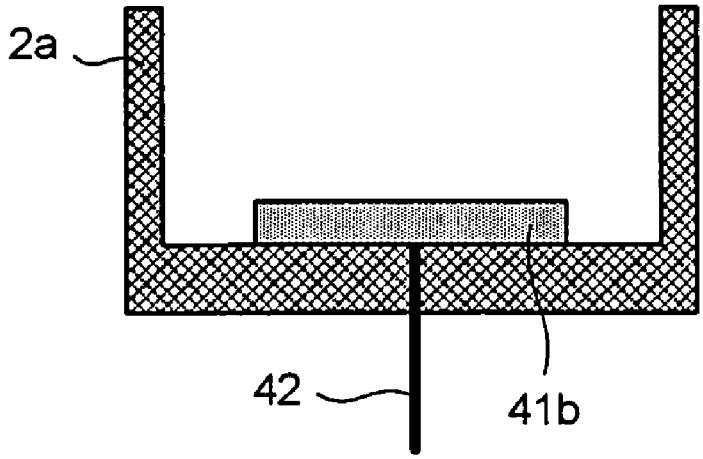
FIG. 6A is a schematic view for the explanation of a process for producing each of the insulating cathodes shown in FIG. 5.
Figure 6B:
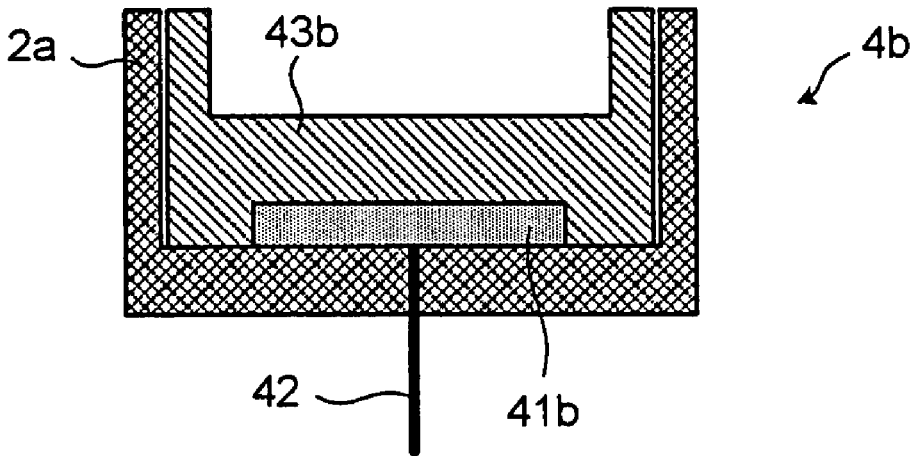
FIG. 6B is a schematic view for the explanation of another process for producing the insulating cathode.

FIGS. 6A and 6B depict a method for producing each of the insulating cathodes 4*b*. First, a glass member 2*a* that has a concave section shown in FIG. 6A is prepared. The glass member 2*a* is to form the ends of the hollow housing 2, and is equivalent to the hollow housing forming member in claims.

The extraction electrode 42 is placed in such a position that the end of the extraction electrode 42 is located on approximately the same plane as the inner wall surface of the hollow housing 2, as shown in FIG. 6A, to the glass member 2*a*. In this state, the extraction electrode 42 and the glass member 2*a* are fusion-bonded to each other. Alternatively, with the end of the extraction electrode 42 protruding from the inner wall surface of the hollow housing 2, the glass member 2*a* and the extraction electrode 42 may be fusion-bonded to each other, and the protruding end of the extraction electrode 42 may be cut off so that the end of the extraction electrode 42 can be located on approximately the same plane as the inner wall surface of the hollow housing 2.

The film-like supporting body 41*b* is then formed on the inner wall surface of the hollow housing 2 by a known technique such as a sputtering technique or a vapor deposition technique. The insulating diamond film 43*b* is then formed to cover both the inner surfaces of the glass member 2*a* and the film-like supporting body 41*b*, as shown in FIG. 6B. Thus, the insulating cathode 4*b* is produced. Unlike in the first and second embodiments, the insulating diamond film 43*b* needs to be formed on a glass surface in the third embodiment. Therefore, the film formation must be performed at a lower temperature than the temperatures at which the diamond film formation is carried out by a conventional CVD technique. However, it is a known fact that a nanocrystal diamond film having nano-sized crystalline particles can be formed on a glass material at a film forming temperature lower than the glass melting point. Accordingly, film formation can be carried out in the manner.

Meanwhile, a hollow housing (not shown) that has open ends and is made of glass or the like is prepared, and the fluorescent film 3 is formed in the hollow housing by a known technique. The hollow housing is then filled with the discharge gas 5, and both ends of the hollow housing are sealed with the insulating cathodes 4*b* produced in the manner. Thus, the cold cathode discharge lamp 1B is produced.

According to the third embodiment, each supporting body 41*b* is covered with the insulating diamond film 43*b* and the hollow housing 2, and therefore, the hollow housing 2 functions as insulating layers like the insulating layers 44 of the first embodiment and the insulating layers 44*a* of the second embodiment. Accordingly, the surface conductive layer formed on the surface of each insulating diamond film 43*b* can be prevented from short-circuiting to the supporting body 41*b* and breaking an electric discharge of a dielectric barrier discharge type. In this manner, the same effects as those of the first embodiment and the second embodiment can be achieved. Furthermore, as the hollow housing 2 also functions as insulating layers, it becomes unnecessary to form separate insulating layers.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cold cathode discharge lamp comprising:

a transparent hollow housing;

a fluorescent film formed on inner surfaces of the hollow housing;

a pair of cold cathodes that are located in the hollow housing; and a discharge gas that contains hydrogen gas sealed within the hollow housing, wherein each of the cold cathodes includes:

a supporting body that has conductivity;

an insulating diamond film formed on the supporting body, the insulating diamond film having an exposed surface exposed to the discharge gas; and an insulating layer that is not a diamond film, and insulates electrically the supporting body from the exposed surface of the insulating diamond film.

2. The cold cathode discharge lamp according to claim 1, wherein each of the cold cathodes includes an electrode that is connected to a part of the supporting body and extends from the inside to the outside of the hollow housing.

3. The cold cathode discharge lamp according to claim 1, wherein the supporting body extends from the inside to the outside of the hollow housing; and the insulating layer is formed at least between the insulating diamond film and part of the supporting body that are located inside the hollow housing.

4. The cold cathode discharge lamp according to claim 1, wherein each of the cold cathodes includes an electrode that is connected to a part of the supporting body and extends from the inside to the outside of the hollow housing;

the supporting body is in contact with an inner surface of the hollow housing; and the hollow housing serves as the insulating layer.

5. The cold cathode discharge lamp according to claim 1, wherein the insulating diamond film has a hydrogen-terminated surface.

6. A cold cathode comprising:

a supporting body that has conductivity;

an insulating diamond film formed on the supporting body, the insulating diamond film having an exposed surface to be exposed to a discharge gas; and an insulating layer that is not a diamond film, and insulates electrically the supporting body from the exposed surface of the insulating diamond film.

7. The cold cathode according to claim 6, wherein the insulating layer is formed on surfaces of the supporting body; and the insulating diamond film is formed over the insulating layer.

8. A cold cathode comprising:

a hollow housing forming member that forms a part of a hollow housing of a cold cathode discharge lamp;

a supporting body having conductivity that is in contact with the hollow housing forming member;

an insulating diamond film formed on the supporting body, the insulting diamond film having an exposed surface to be exposed to discharge gas; and an electrode that penetrates the hollow housing forming member and is joined to the supporting body;

wherein the hollow housing forming member insulates electrically the supporting body from a the exposed surface of the insulating diamond film.

9. The cold cathode according to claim 8, wherein the hollow housing forming member forms the longitudinal ends of the hollow housing that takes the form of a cylinder.

* * * * *